US008601996B2

(12) United States Patent
Miller et al.

(10) Patent No.: US 8,601,996 B2
(45) Date of Patent: Dec. 10, 2013

(54) SINGLE PIECE PISTON BODY FOR AN INTERNAL COMBUSTION ENGINE

(75) Inventors: Dion R. Miller, Princeville, IL (US); Indrajith Kizhakkethara, West Lafeyette, IN (US); Stephen Kelly, Melissa, TX (US)

(73) Assignee: Caterpillar Inc., Peoria, IL (US)

( * ) Notice: Subject to any disclaimer, the term of this patent is extended or adjusted under 35 U.S.C. 154(b) by 305 days.

(21) Appl. No.: 12/776,572

(22) Filed: May 10, 2010

(65) Prior Publication Data

US 2011/0114054 A1 May 19, 2011

Related U.S. Application Data

(60) Provisional application No. 61/176,648, filed on May 8, 2009.

(51) Int. Cl.
*F02F 3/00* (2006.01)

(52) U.S. Cl.
USPC ..... 123/193.6; 92/212; 92/216; 92/187; 92/186; 92/188

(58) Field of Classification Search
USPC ..... 123/193.6; 92/186–188, 212, 216
See application file for complete search history.

(56) References Cited

U.S. PATENT DOCUMENTS

| | | | | |
|---|---|---|---|---|
| 4,941,440 | A | 7/1990 | Weber et al. | |
| 6,152,016 | A * | 11/2000 | Bahr et al. | 92/160 |
| 6,324,961 | B1 * | 12/2001 | Akimoto et al. | 92/160 |
| 6,675,762 | B2 | 1/2004 | Han | |
| 6,772,846 | B1 * | 8/2004 | Scharp | 173/1 |
| 7,406,941 | B2 | 8/2008 | Zhu et al. | |
| 7,603,977 | B2 * | 10/2009 | Heidrich et al. | 123/193.6 |
| 8,047,123 | B2 * | 11/2011 | Lahrman | 92/186 |
| 2002/0023609 | A1 * | 2/2002 | Laimbock | 123/193.6 |
| 2006/0096557 | A1 * | 5/2006 | Christain et al. | 123/41.38 |
| 2007/0074695 | A1 * | 4/2007 | Gildemeister et al. | 123/193.6 |
| 2007/0079775 | A1 * | 4/2007 | Lin et al. | 123/41.35 |
| 2007/0209614 | A1 * | 9/2007 | Scharp | 123/41.67 |
| 2007/0251487 | A1 | 11/2007 | Heidrich et al. | |
| 2007/0261658 | A1 * | 11/2007 | Abe et al. | 123/193.6 |

* cited by examiner

*Primary Examiner* — Marguerite McMahon
*Assistant Examiner* — James Kim
(74) *Attorney, Agent, or Firm* — Baker Hostetler

(57) ABSTRACT

A single-piece piston body for an internal combustion engine includes a crown portion having a circumferential ring belt including an oil ring groove configured to accommodate an oil control ring and a skirt portion having a first skirt wall disposed on the major thrust side and a second skirt wall disposed on the minor thrust side of the piston, and two box walls that connect the skirt walls and which are set back with respect to the ring belt. A first plurality and a second plurality of axial drain passages extend from the oil ring groove to the bottom of the crown portion, the first and second pluralities of axial drain passages being substantially centered at opposite box sides of the piston and each plurality of axial drain passages spanning an arcuate portion of about 45-75 degrees.

20 Claims, 3 Drawing Sheets

SINGLE PIECE PISTON BODY FOR AN INTERNAL COMBUSTION ENGINE

TECHNICAL FIELD

This disclosure relates to single piece piston bodies for internal combustion engines.

BACKGROUND

Pistons for internal combustion engines such as heavy duty compression ignition engines are complex products subject to a wide range of duty requirements. Such pistons operate in extremely harsh environments whilst having to produce good performance, emissions and durability characteristics over a wide range of loads, speeds, ambient conditions and with fuels the specification of which can vary dramatically. In a field where so many variables have significant impact on development, numerous piston designs have seen the light of day, as rarely will an off-the-shelf piston be suitable for a new or modified engine system. Furthermore, the piston can be designed from a very extensive set of design variables whereby a suitable combination of variables goes far beyond simple design selection but requires significant inventive efforts, research and development. Hence, not withstanding the prior art field for pistons already being very extensive, improvements can still be made, as new or modified engine systems tend to pose unique problem sets, requiring unique solutions.

One piston known in the prior art is an articulated piston, i.e. the upper portion (crown) and the lower portion (skirt) are only held together via the wrist pin, whereby the crown may be a steel component and the skirt may be made from aluminium. One such piston, for example a Ferrotherm® piston from Mahle® includes four axial drain passages between the oil ring groove and a lower open space. The four axial drain holes are distributed uniformly around the circumference of the oil ring groove, i.e. all drain passages are spaced 90 degrees apart from each other, with two passages being positioned over the central axis of the wrist pin bores and two passages being positioned centrally over the skirt walls. The four holes allows substantially uniform drainage of oil from all around the oil ring groove thereby lubricating the skirt walls.

Another piston known in the art is a single piece piston having only two axial drain passages arranged at 180 degrees angles relative to each other, they being located over the central axis of the wrist pin bores. One example of this piston is the Monotherm® piston manufactured by Mahle®.

Both the articulated and single piece pistons have been successful in many applications, however, it was found that in some applications these pistons may be unsuitable because of a lack of durability, excessive carbon built-up on the crown, lack of performance and excessive oil consumption and manufacturability issues.

Hence it is an object of the current disclosure to provide an improved piston design addressing at least some of the aforementioned disadvantages.

SUMMARY OF THE INVENTION

In a first aspect there is disclosed a single-piece piston body for an internal combustion engine comprising a crown portion having a circumferential ring belt including an oil ring groove configured to accommodate an oil control ring. It further comprises a skirt portion having a first skirt wall disposed on the major thrust side and a second skirt wall disposed on the minor thrust side of the piston, and two box walls that connect the skirt walls and which are set back with respect to the ring belt. The single piece piston body is further provided with a first plurality and a second plurality of axial drain passages extending from the oil ring groove to the bottom of the crown portion, the first and second pluralities of axial drain passages being substantially centered at opposite box sides of the piston and each plurality of axial drain passages spanning an arcuate portion of about 45-75 degrees.

In a further aspect there is disclosed a piston assembly for an internal combustion engine comprising a single-piece piston body for an internal combustion engine including a crown portion a circumferential ring belt including an oil ring groove configured to accommodate an oil control ring, the crown portion at least partially defining an annular cooling gallery. The single piece piston body further includes a skirt portion having first and second skirt walls connected by first and second box walls, the first and second box walls being set closer to the longitudinal centerline of the piston body relative to the skirt walls thereby creating first and second external cavities below the crown portion. A first plurality of axial drain passages fluidly connects the oil ring groove with the first external cavity and a second plurality of axial drain passages fluidly connects the oil ring groove with the second external cavity, each plurality of axial drain passages spanning an arcuate portion of no more than about 75 degrees with the arcuate portions being substantially centered in those portions of the crown that span the box sides of the piston. The piston assembly further includes a cover plate at least partially covering the cooling gallery, the cover plate being provided with a plurality of openings corresponding to the axial drain passages.

In yet a further aspect there is disclosed a single-piece piston body for an internal combustion engine, comprising a crown portion having a circumferential ring belt including an oil ring groove configured to accommodate an oil control ring. The piston body further includes a skirt portion having a first skirt wall disposed on the major thrust side and a second skirt wall disposed on the minor thrust side of the piston and two box walls that connect the skirt walls and which are set back with respect to the ring belt. A first plurality of axial drain passages including a primary and at least two auxiliary drain passages and a second plurality of axial drain passages including a primary and at least two auxiliary drain passages extend from the oil ring groove to the bottom of the crown portion, none of the axial drain passages being located at the skirt wall sides of the piston body.

DETAILED DESCRIPTION

Reference will now be made in detail to specific embodiments or features, examples of which are illustrated in the accompanying drawings. Generally, the same or corresponding reference numbers will be used throughout the drawings to refer to the same or corresponding parts. It should be appreciated that the terms "upper," "lower," "top," "bottom," "up," "down," and other terms related to orientation are being used solely to facilitate the description of the objects as they are depicted in the figures and should not be viewed as limiting the scope of this description to the orientations associated with each of these terms. It should further be understood that where in this description the term "about" is used in relation to a value, the term "about" is defined as plus or minus (+/−) 10% of the value as disclosed.

Figure 1:
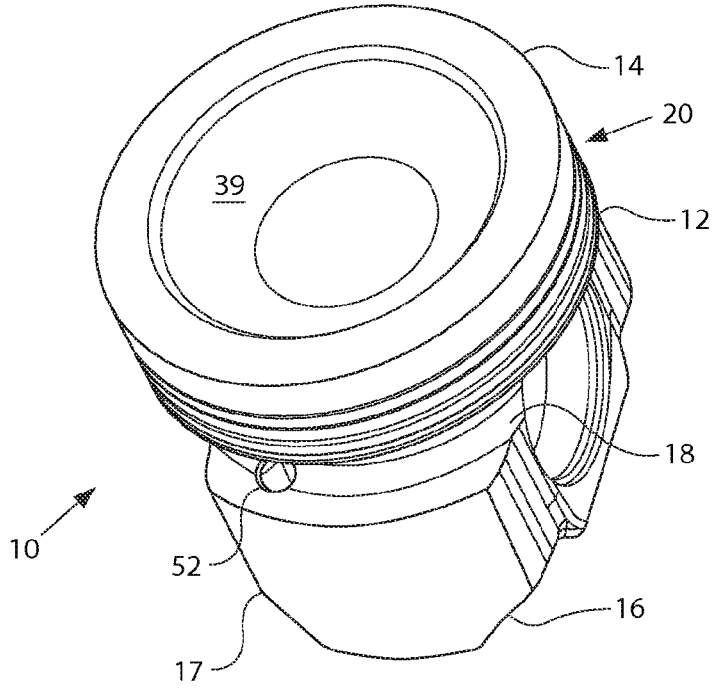
FIG. 1 shows an isometric representation of a piston in accordance with the current disclosure.
Figure 2:
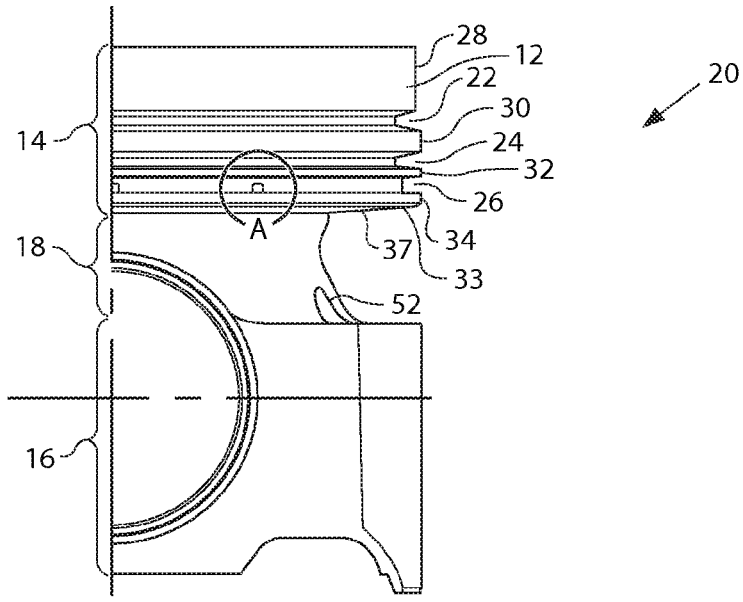
FIG. 2 shows a partial side view of the piston of FIG. 1.

As best shown in FIG. 1, a piston 10 has a single-piece piston body 12 defining a crown portion 14, a skirt portion 16 and an intermediate portion 18 in between the crown portion 14 and the skirt portion 16. The single-piece piston body 12 is made of steel or any other material as customary and may be formed by a process that includes a forging step. referring to FIG. 2, the crown portion 14 is provided with a circumferential ring belt generally designated as the circumferential ring belt 20. The circumferential ring belt 20 may include a first compression ring groove 22 and a second compression ring groove 24 and be configured to accommodate first and second compression rings respectively (not shown). The circumferential ring belt further includes an oil ring groove 26 configured to accommodate an oil control ring (not shown). The ring belt 20 is further provided with a top land 28, a first land 30, a second land 32 and a lower land 34.

Figure 3:
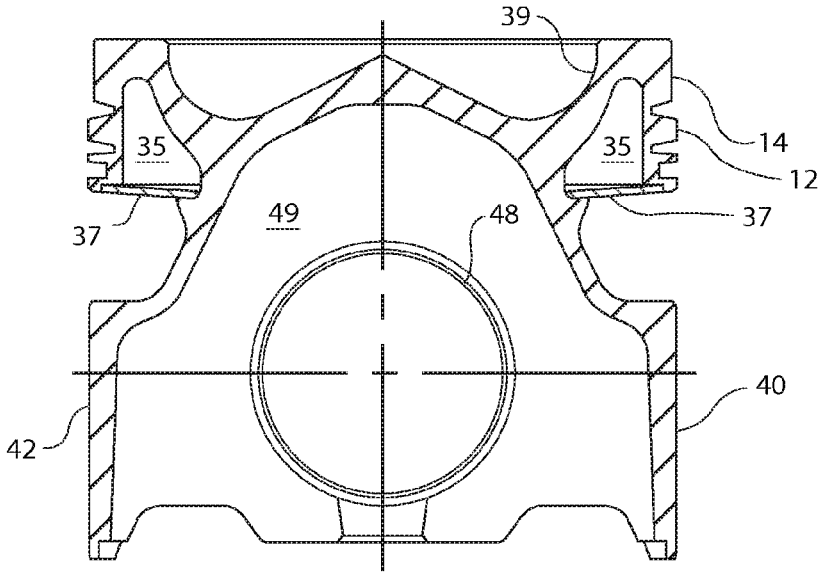
FIG. 3 shows a first cross-sectional representation of the piston of FIG. 1, the cross-sectional view being taken along a central plane passing through both skirt walls
Figure 4:
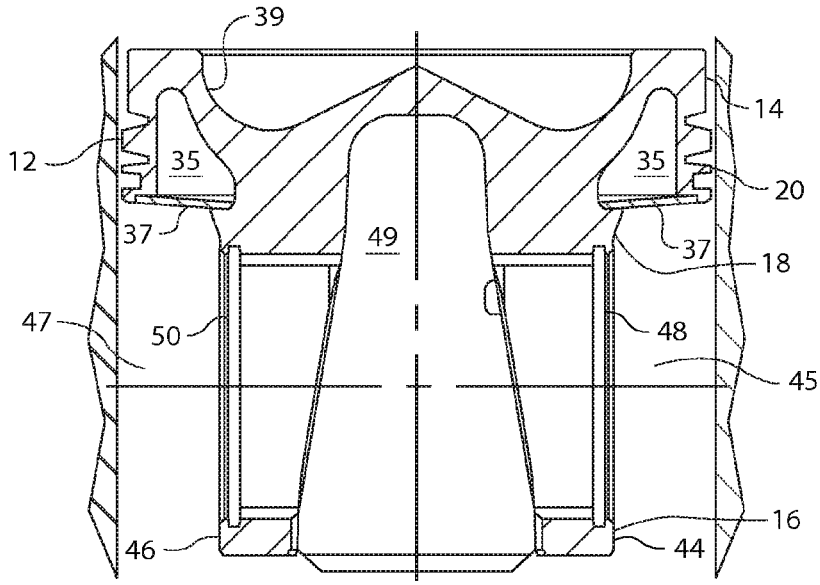
FIG. 4 shows a second cross-sectional representation of the piston of FIG. 1, the cross-sectional view being taken along a central plane passing through both box walls.

As best seen in FIGS. 1, 3 and 4, the crown portion 14 may be provided with any suitably shaped combustion bowl 39. For high power ratings the crown portion 14 and or the combustion bowl 39 may be provided with a combustion bowl insert (not shown) manufactured from a high performance steel such as Inconel® and the insert may be welded onto the base material of the piston body 12.

Referring to FIGS. 3 and 4, the crown portion 14 may include, and at least partially define, an annular cooling gallery 35. A cover plate 37 may cover the cooling gallery 35 at the lower end 33 of the cooling gallery 35. The cover plate 37 may be in an interference fit arrangement with the piston body 12 and may be a two piece design to ease assembly.

Figure 5:
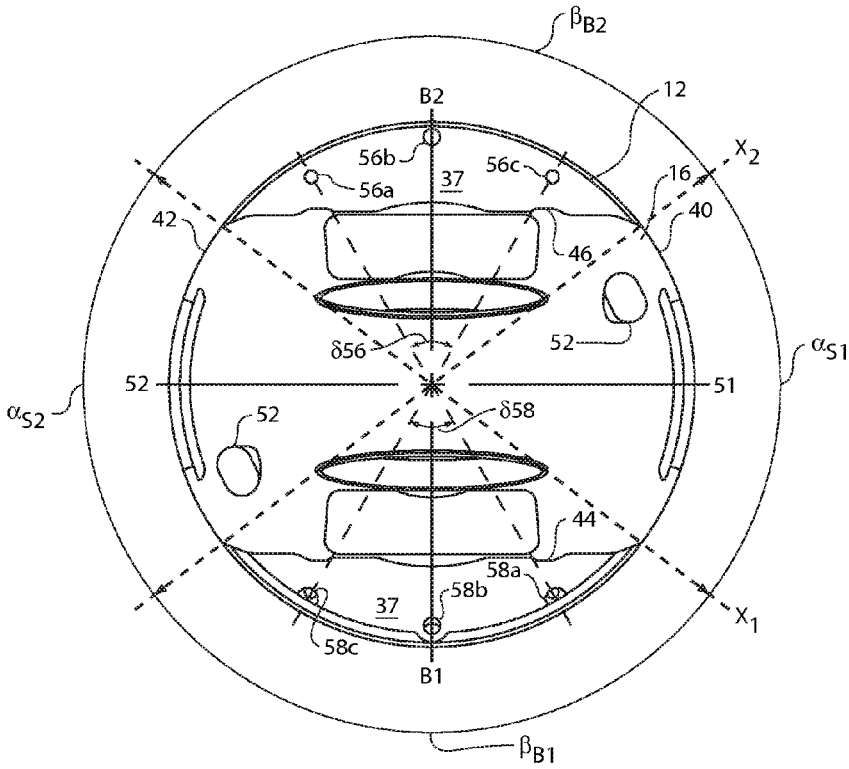
FIG. 5 shows a bottom view of the piston of FIG. 1.
Figure 6:
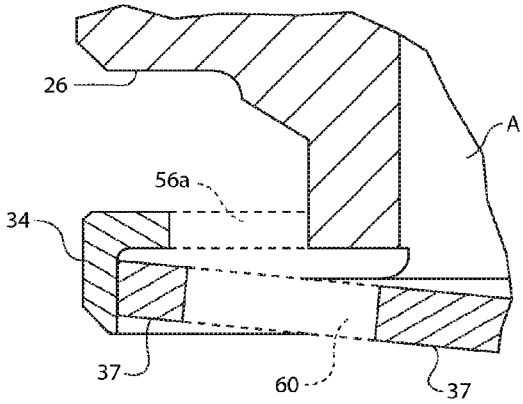
FIG. 6 shows an enlarged cross-sectional detail of "A" from FIG. 2.

Referring to FIG. 5, the skirt portion 16 may have a box-style skirt 17 with curved first and second skirt walls 40 and 42, and generally straight first and second box walls 44 and 46 connecting the first and second skirt walls 40 and 42. The first and second skirt walls 40 and 42 are disposed on the major thrust side and minor thrust side of the piston respectively. The first and second skirt walls 40 and 42 may have different thicknesses if desired to withstand the different thrust loadings resulting from the combustion cycle and forces in connection with the crankshaft rotation. The first and second box walls 44 and 46 are set back relative to the circumferential ring belt 20, i.e. the average distance between first and second box walls 44 and 46 is less than the average distance between the first and second skirt walls 40 and 42. In other words, and as best seen in FIG. 5, the generally box-like shape of the skirt portion 16 is defined by the two generally flat box walls 44 and 46 and the two generally curved skirt walls 40 and 42.

As best shown in FIG. 1, because the first and second box walls 44 and 46 are set back relative to the circumferential ring belt 20 two generally kidney shaped cavities 45 and 47 are formed below the crown portion 14 and adjacent to the first and second box walls 44 and 46 when piston 10 is reciprocatingly disposed in a cylinder or cylinder liner within an engine block (not shown). FIG. 5 further shows reference axes X1 and X2 each intersecting the corners of the skirt walls 40 and 42 and the box walls 44 and 46 respectively thereby defining four sides of the piston body 12, i.e. opposite first and second box sides B1 and B2, and opposite first and second skirt sides S1 and S2.

Referring to FIG. 4, the skirt portion 16 is provided with first and second wrist pin bosses 48 and 50 extending through the box walls 44 and 46 respectively. Portions of the wrist pin bosses 48 and 50 may extend at least partially into the intermediate portion 18 of the piston 10. Between the wrist pin bosses 48 and 50 and extending towards the crown portion 14 of the piston body 12 is an internal cavity 49.

During operation, the piston is customarily cooled by receiving oil from at least one or two engine oil spray nozzles (not shown) commonly mounted in the engine crankcase and configured to spray oil to the underside of the piston 10 and deep into the internal cavity 49. The piston body 12 may be provided with a number of cooling passages 52 (FIG. 1) to enable oil from the spray nozzles to enter and evacuate the cooling gallery 35. The cooling passages 52 are typically aligned with holes (not shown) in the cover plate 37 to aide in oil spray movement deep into the cooling gallery 35. The cooling passages 52 and holes in the cover plate 37 may be aligned with the spray nozzle such that during certain periods of the piston cycle the jet from the spray nozzle can directly enter the cooling gallery 35.

Referring to FIG. 5, the piston body 12 is provided with a primary axial drain passage 56*b* and two auxiliary axial drain passages 56*a* and 56*c*. The piston body 12 is further provided with a primary axial drain passage 58*b* and two auxiliary axial drain passages 58*a* and 58*c*. The first and second plurality of axial drain passages 56*a-c* and 58*a-c* are axial drain passages extending from the oil ring groove 26 to the bottom of the crown portion 14 such that during operation oil can drain from the oil ring groove 26 into the first and second generally kidney-shaped cavities 45 and 47. The draining effect may at least in part be gravity assisted. Any axial drain passages in the first and second plurality of axial drain passages 56 and 58 are therefore at least partially located between the oil ring groove 26 and the cooling gallery 35 without fluidly connecting them. The axial drain passages may for example be formed by drilling through the bottom wall of the crown portion 14 into the oil ring groove 26. A number of corresponding passages 60 may be formed in the cover plate 37. For clarity purposes the portion of the cover plate normally found on side B1 of the piston 10 has been omitted from FIG. 5.

From operating and testing it was found that the articulated pistons with the 4 drain back holes at 90 degrees spacings as used until then were not well suited for certain applications of long stroke diesel engines. It was similarly found that a single piece piston having only two axial drain passages arranged at 180 degrees angles relative to each other was also not suited for those applications. It was found that the piston not always performed satisfactorily or lasted for a suitable duration of length. For example, on multiple pistons excessive carbon deposits had built up on the top land at low hours of operation. Carbon deposits may be particularly damaging to the engine as the deposit may cause bore polishing thereby deteriorating the performance of the engine and eventually necessitating a premature engine overhaul. Furthermore, it was observed that ring projection was excessive after low hours of operation. Carbon deposits built up in the ring grooves, particularly behind the rings in the first and second compression ring grooves, and pushed the rings outwards. As a result, the projecting rings were forced hard up against the cylinder bore or liner, causing premature wear or failure of the rings and bore/liner. Lastly it was observed that the oil consumption was excessive after low hours of operation. Oil consumption performance especially deteriorated at engine operation outside the rated load and speed range.

Compared to the articulated pistons with the 4 drain back holes at 90 degrees spacings, the following combination of features was surprisingly found to provide good results regarding, performance, durability and manufacturability. Rather than using the articulated piston it was found that a single piece piston body 12 having a steel skirt portion 16 rather than an aluminium skirt was more durable. The performance of the four drain passage design of the articulated piston, where the passages are uniformly arranged at 90 degree intervals to provide a uniform drain system all around the oil ring groove, was appealing but caused manufacturability issues for the proposed single piece steel piston body 12. In contrast to the poor performance of the articulated piston, the piston body 12 is provided improved performance when the first and second pluralities of axial drain passages 56 and 58 were substantially centered within the opposite box sides B1 and B2 of the piston body 12 and each plurality of axial drain passages 56 and 58 spans an arcuate portion with an angular width of about 45-75 degrees and preferably about 60 degrees. The arcuate width is measured as the angle between the centerlines of the two most extreme axial drain passages, e.g. in FIG. 5 that would be the angle $\delta_{56}$ between the centerlines of the axial drain passages 56*a* and 56*c*, and the angle $\delta_{58}$ between the centerline of axial drain passages 58*a* and 58*c*. The term "centered" is further to be understood as the center of the pluralities of axial drain passages 56 and 58 being spaced equidistant from both opposite skirt walls S1 and S2. In operation piston of 10 it was found that having a non-uniform distribution of axial drain passages around the oil ring groove provided notable performance despite there being no axial drain passage located at either of the skirt wall sides S1 and S2 of the piston body 12. Including two auxiliary drain passages 56*a* and 56*c* in combination with the primary drain passage 56*b* and two auxiliary drain passages 58*a* and 58*c* in combination with the primary passage 58*b*, performance of the engine was significantly improved. A cross-sectional diameter of about four millimeters for the axial drain passages 56*a-c* and 58*a-c* was found to provide an acceptable performance without unacceptably interfering with structural integrity, durability and manufacturability of the piston 10 and/or piston body 12. The number of axial drain passages in the first and second plurality of drain passages 56 and 58 and/or the position of the first and second plurality of drain passages 56 and 58 being centered relative to their respective first and second box walls 44 and 46 was found to be especially advantageous in embodiments where each of the first and second skirt walls 40 and 42 extended circumferentially over angles $\alpha_{S1}$ and $\alpha_{S2}$ respectively whereby $\alpha_{S1}$ and $\alpha_{S2}$ are in a range of about 80 degrees. Correspondingly the angles $\beta_{B1}$ and $\beta_{B2}$ over which the first and second box walls 44 and 46 extend are then in the range of about 100 degrees.

Industrial Applicability

A single piece piston body 12 as disclosed can be used in an internal combustion engine and is particularly, but not exclusively, suited for use in a long stroke diesel engine. The disclosed design provides an improvement over the prior art, especially with regards to performance, durability and manufacturability.

Although the preferred embodiments of this disclosure have been described herein, improvements and modifications may be incorporated without departing from the scope from the following claims.

What is claimed is:

1. A single-piece piston body for an internal combustion engine, comprising:

a crown portion having a circumferential ring belt and a bottom wall, the circumferential ring belt including an oil ring groove that is configured to accommodate an oil control ring, the crown portion at least partly defining an annular cooling gallery;

a skirt portion having a first skirt wall disposed on a major thrust side of the piston and a second skirt wall disposed on a minor thrust side of the piston, and two box walls that connect the skirt walls and which are set back with respect to the ring belt;

a first plurality of drain passages and a second plurality of drain passages, extending from the oil ring groove to the bottom wall of the crown portion, being substantially centered at opposite box sides of the piston, and spanning an arcuate portion of about 45-75 degrees; and a cover plate at least partially covering the annular cooling gallery, the cover plate defining at least one opening therethrough, the at least one opening at least partially overlapping an aperture of one of the plurality of axial drain passages in a circumferential direction about the oil ring groove.

2. The single-piece piston body according to claim 1, wherein each plurality of drain passages includes a primary passage and at least two auxiliary passages.

3. The single-piece piston body according to claim 1, wherein each plurality of drain passages includes at least three passages and spans an arcuate portion of about 60 degrees.

4. The single-piece piston body according to claim 1, wherein each box wall spans an arcuate portion of about 100 degrees.

5. The single-piece piston body according to claim 1, wherein said drain passages are at least partially located between said annular cooling gallery and said oil ring groove in a radial direction extending normal to an axis of revolution of the oil ring groove, without fluidly connecting said annular cooling gallery and said oil ring groove.

6. The single-piece piston body according to claim 1, wherein no drain passages are provided in the crown portions over the skirt walls of the piston.

7. A piston assembly for an internal combustion engine comprising a single-piece piston body for an internal combustion engine, including:

a crown portion having a circumferential ring belt and a bottom wall, the circumferential ring belt including an oil ring groove that is configured to accommodate an oil control ring, the crown portion at least partially defining an annular cooling gallery;

a skirt portion having first and second skirt walls connected by first and second box walls, the first and second box walls being set closer to the longitudinal centerline of the piston body relative to the skirt walls thereby defining first and second generally kidney shaped cavities below the crown portion;

a first plurality of drain passages, including a primary passage and two auxiliary passages, extending from the oil ring groove to the bottom wall of the crown portion and fluidly connecting the oil ring groove with the first generally kidney shaped cavity;

a second plurality of drain passages, including a primary passage and two auxiliary passages, extending from the oil ring groove to the bottom wall of the crown portion and fluidly connecting the oil ring groove with the second generally kidney shaped cavity; and a cover plate, at least partially covering the annular cooling gallery, the cover plate defining at least one opening therethrough, the at least one opening at least partially overlapping an aperture of one of the plurality of axial drain passages in a circumferential direction about the oil ring groove to allow oil to drain from the oil ring groove to the first and second generally kidney shaped cavities, wherein each plurality of drain passages spans an arcuate portion of no more than about 75 degrees with the arcuate portions substantially centered in those portions of the crown that span the box sides of the piston.

8. A single-piece piston body for an internal combustion engine, comprising:

a crown portion having a circumferential ring belt and a bottom wall, the circumferential ring belt including an oil ring groove that is configured to accommodate an oil control ring, the crown portion at least partly defining an annular cooling gallery;

a skirt portion having a first skirt wall disposed on a major thrust side of the piston and a second skirt wall disposed on a minor thrust side of the piston, and two box walls that connect the skirt walls and which are set back with respect to the ring belt;

a first plurality of drain passages including a primary and at least two auxiliary drain passages and a second plurality of drain passages including a primary and at least two auxiliary drain passages, each plurality of drain passages extending from the oil ring groove to the bottom wall of the crown portion; and a cover plate at least partially covering the annular cooling gallery, the cover plate defining at least one opening therethrough, the at least one opening at least partially overlapping an aperture of one of the plurality of axial drain passages in a circumferential direction about the oil ring groove, wherein none of the drain passages are located at skirt wall sides of the piston body.

9. The piston assembly according to claim 7, wherein each plurality of drain passages spans an arcuate portion of about 45-75 degrees.

10. The piston assembly according to claim 9, wherein each plurality of drain passages spans an arcuate portion of about 60 degrees.

11. The piston assembly according to claim 7, wherein each box wall spans an arcuate portion of about 100 degrees.

12. The piston assembly according to claim 7, wherein said drain passages are at least partially located between said annular cooling gallery and said oil ring groove in a radial direction extending normal to an axis of revolution of the oil ring groove, without fluidly connecting said annular cooling gallery and said oil ring groove.

13. The piston assembly according to claim 7, wherein no drain passages are provided in the crown portions over the skirt walls of the piston.

14. The single-piece piston body according to claim 8, wherein each plurality of drain passages spans an arcuate portion of about 45-75 degrees.

15. The single-piece piston body according to claim 14, wherein each plurality of drain passages spans an arcuate portion of about 60 degrees.

16. The single-piece piston body according to claim 8, wherein said drain passages are at least partially located between said annular cooling gallery and said oil ring groove in a radial direction extending normal to an axis of revolution of the oil ring groove, without fluidly connecting said annular cooling gallery and said oil ring groove.

17. The single-piece piston body according to claim 1, wherein the single-piece piston body defines a cooling passage therethrough, and the cooling passage is aligned with the at least one opening through the cover plate such that a jet of engine oil from the cooling passage may enter the annular cooling gallery through the at least one opening through the cover plate.

18. The single-piece piston body according to claim 1, wherein the at least one opening through the cover plate consists of a plurality of openings through the cover plate.

19. The single-piece piston body according to claim 1, wherein the at least one opening through the cover plate at least partially overlaps the aperture of one of the plurality of axial drain passages in a radial direction, the radial direction extending normal to an axis of revolution of the oil ring groove.

20. The single-piece piston body according to claim 17, further comprising an intermediate portion disposed between the crown portion and the skirt portion, the intermediate portion having a radial dimension smaller than a diameter of the oil ring groove, the radial dimension extending normal to an axis of revolution of the oil ring groove, wherein the cooling passage extends through the intermediate portion of the single-piece piston body.

* * * * *